US006492631B2

(12) United States Patent
Ninomiya

(10) Patent No.: US 6,492,631 B2
(45) Date of Patent: Dec. 10, 2002

(54) APPARATUS FOR QUENCHING METALLIC MATERIAL

(75) Inventor: Susumu Ninomiya, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/842,217

(22) Filed: Apr. 26, 2001

(65) Prior Publication Data

US 2001/0050281 A1 Dec. 13, 2001

(30) Foreign Application Priority Data

Apr. 27, 2000 (JP) ..... 2000-127110

(51) Int. Cl.[7] ..... H05B 6/10; F27D 7/06
(52) U.S. Cl. ..... 219/635; 219/651; 373/140
(58) Field of Search ..... 219/635, 602, 219/628, 632, 645, 646, 651, 653, 654, 655, 657, 658; 373/138, 139, 140, 141

(56) References Cited

U.S. PATENT DOCUMENTS

| | | | | |
|---|---|---|---|---|
| 4,653,732 A | | 3/1987 | Wunning et al. | 266/250 |
| 6,235,235 B1 | * | 5/2001 | Checketts | 266/153 |

FOREIGN PATENT DOCUMENTS

| | | |
|---|---|---|
| DE | 35 05 689 A1 | 8/1986 |
| EP | 0 484 667 A1 | 5/1992 |
| EP | 0 621 344 A1 | 10/1994 |
| EP | 0 785 402 A1 | 7/1997 |
| EP | 1 057 897 A2 | 12/2000 |
| JP | 60-145327 | 7/1985 |
| JP | 62-136533 | 6/1987 |

OTHER PUBLICATIONS

J.D. Keller, "Continuous Annealing in Molten Sodium", *Iron and Steel Engineer*, pp. 125–133, (Nov. 1959).

* cited by examiner

*Primary Examiner*—Tu Ba Hoang
(74) *Attorney, Agent, or Firm*—Foley & Lardner

(57) ABSTRACT

An apparatus for quenching a metallic material such as steel is provided. The apparatus includes a heating furnace, a liquid metal sodium chamber, a gas cooling chamber, and a liquid metal sodium removal chamber. The heating furnace heats the metallic material to more than 700° C. The liquid metal sodium chamber includes liquid metal sodium, and the metallic material is cooled approximately to between 100° C. and 250° C. The inert gas chamber includes inert gas such as nitrogen or argon, and the metallic material is cooled approximately to room temperature. In the liquid metal sodium removal chamber, the liquid metal sodium remaining on the metallic materials is removed by using vapor, mist, and water.

33 Claims, 4 Drawing Sheets

APPARATUS FOR QUENCHING METALLIC MATERIAL

BACKGROUND

1. Field of the Invention

The present invention relates to an apparatus for quenching a metallic material, and more particularly to a quenching apparatus capable of improving strength, hardness and dimension preciseness of a metallic material such as a mechanical component, and thereby diminishing wear and corrosion of the surface of the metallic material.

2. Description of the Related Art

In a quenching method, metallic material may be heated by an electric furnace, a gas furnace, a vacuum furnace, a fire furnace, or an induction furnace and is then cooled by a coolant such as gas, water, oil, or a polymer. The performance of a hardened metallic material depends on atmosphere such as cooling velocity, cooling temperature, or cooling pattern based on velocity and temperature.

In order to increase cooling velocity, the coolant in which a metallic material is soaked is mixed, or the coolant is sprayed on a metallic material from a jet nozzle. Apart from this, molten salt, molten tin, or molten lead, which is not boiled in high temperature, may cool a metallic material rapidly.

It is said that cooling a metallic material uniformly and rapidly is important to improve the characteristics thereof. However, if the temperature exceeds the boiling points of the above-mentioned coolants, these coolants boil and generate a vapor film on a portion of a metallic material. Additionally, the temperature of the portion cannot decrease rapidly. Thereby, processed metallic material has surface areas that have large temperature differences.

Specifically, if a metallic material heated to 800° C. is hardened by water, oil, or a polymer, a vapor film is generated on the surface of the metallic material at a temperature more than 550° C. This decreases the cooling velocity of the metallic material, because the cooling velocity is developed, according to experiments, when the vapor film vanishes in a low temperature.

Furthermore, a generated vapor film vanishes gradually from edge portions of a metallic material. Thus, vapor films are generated in some portions and are not generated in other portions, and the temperature differences thereof are known to be approximately 200° C. to 300° C.

According to the temperature differences, thermal shrinkage occurs in the metallic material, and the metallic material deforms, cracks, bends, or distorts. This phenomenon can be seen especially when employing water for quenching.

In order to overcome this problem in the water quenching, gas, oil, or a polymer is usually chosen. However, cooling velocity cannot be increased enough when using gas, and the obtained hardness of a metallic material is relatively low. In the case of using oil or a polymer, deformation, cracking, bending, and distortion are avoided in comparison with the case of using water. However, this improvement is not enough, and the cooling velocity is not increased enough. Further, the residual compressive stress on the surface of a hardened material declines in comparison with the water quenching, and sometimes a residual tensile stress appears, thereby decreasing the fatigue strength.

Molten salt does not generate vapor films. However, the high temperature condition for utilizing molten salt requires effort for quenching, and the handling of molten salt burdens the environment. Similarly, when substituting tin or lead, the process temperature has to be more than the melting point thereof, which also requires effort for quenching, and such a heavy metal is also treated carefully to protect the environmental reason.

SUMMARY OF THE INVENTION

The present invention has been made in view of the above-mentioned circumstances and is intended to solve the above-mentioned problems. In particular, one purpose of the present invention is to provide an apparatus for quenching a metallic material capable of restraining deformation, cracking, bending, and distortion of the metallic material to be hardened, and thereby diminishing wear and corrosion of the metallic material.

Additional purposes and advantages of the invention will be apparent to persons skilled in this field from the following description, or may be learned by practice of the invention.

The present invention provides an apparatus for quenching a metallic material, including: a heater that heats the metallic material; a liquid metal sodium chamber in which a liquid metal sodium is supplied, and the metallic material is cooled to a first temperature in the liquid metal sodium; an inert gas chamber in which an inert gas is supplied, and the metallic material is cooled to a second temperature in the inert gas; and a remover that removes a liquid metal sodium on the metallic material.

The liquid metal sodium may further include a liquid metal sodium potassium or a liquid metal sodium lithium.

The heater may be disposed in a heating furnace. The heating furnace may include a carburization quenching furnace, an induction furnace, or the like. The heater may heat the metallic material approximately to more than 700° C.

The first temperature may be approximately 100° C, and the second temperature may be room temperature. The first temperature may exist between 100° C. and 250° C. The first temperature may also exist between 150° C. and 200° C.

The heater may include a liquid metal sodium or a liquid metal lithium for heating the metallic material.

An inert gas may be supplied to the liquid metal sodium chamber.

The remover may include a liquid metal sodium removal chamber. An inert gas may be supplied to the liquid metal sodium removal chamber.

The remover may include a water. A water may be stored in which the metallic material is soaked for removing the remained liquid metal sodium on the metallic material.

The apparatus may further include a liquid metal sodium circulating line that circulates the liquid metal sodium supplied to the liquid metal sodium chamber. The liquid metal sodium circulating line may include a circulating pump.

The apparatus may further comprise a temperature controller that keeps the temperature of the liquid metal sodium supplied to the liquid metal sodium chamber constant.

The apparatus may further comprise an impurity remover that removes an impurity in the liquid metal sodium supplied to the liquid metal sodium chamber.

The apparatus may further comprise a mixer that mixes the liquid metal sodium supplied in the liquid metal sodium chamber.

The apparatus may further comprise a mixer that mixes the inert gas supplied in the liquid metal sodium removal chamber.

The apparatus may further comprise a mixer that mixes the inert gas supplied in the liquid metal sodium removal chamber.

The apparatus may further comprise a shield that avoids air contacting the liquid metal sodium.

The apparatus may further comprise a transporter that transports the metallic material for the processes.

The present invention also provides an apparatus for quenching a metallic material, including: a heater at a first temperature; a first chamber downstream from the heater and containing a liquid metal sodium at a second temperature lower than the first temperature; a second chamber downstream from the first chamber and containing an inert gas at a third temperature lower than the second temperature; and a liquid metal sodium remover downstream from the second chamber.

The present invention also provides an apparatus for quenching a metallic material, including: a heater for heating the metallic material to a first temperature; a first chamber containing a liquid metal sodium at a second temperature lower than the first temperature for cooling the metallic material heated to the first temperature; a second chamber containing an inert gas at a third temperature lower than the second temperature for cooling the metallic material; and a liquid metal sodium remover for removing a liquid metal sodium from the metallic material.

Further, the present invention also provides a method of quenching a metallic material, including: heating the metallic material to a first temperature; cooling the metallic material in a liquid comprising a liquid metal sodium to a second temperature lower than the first temperature; cooling the metallic material in an inert gas to a third temperature lower than the second temperature; and removing a liquid metal sodium from the metallic material cooled to at least the third temperature.

BRIEF DESCRIPTION OF DRAWINGS

The accompanying drawings, which are incorporated in and constitute a part of this specification, illustrate several preferred embodiments of the invention and, together with the description, serve to explain the principles of the invention.

DESCRIPTION OF THE INVENTION

A processing apparatus for quenching a metallic material of the present invention will now be specifically described in more detail with reference to the accompanying drawings. Wherever possible, the same reference numbers will be used throughout the drawings to refer to the same or like parts.

Figure 2:
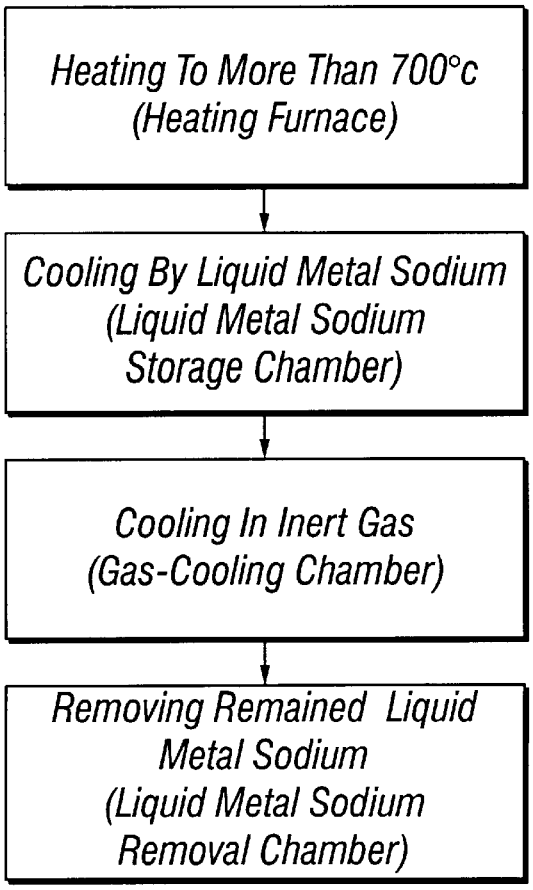
FIG. 2 is a flow chart showing quenching processes, which are employed by an apparatus for quenching a metallic material of the present invention.

FIG. 2 is a flow chart showing quenching processes performed by an apparatus for quenching a metallic material of the present invention.

In Step 1, a metallic material is heated by a furnace to a temperature of more than approximately 700° C. This heating process is executed, for example, for several minutes to several hours by using gas, or during several seconds to several minutes by using molten salt.

In Step 2, the heated metallic material heated to more than approximately 700° C. is cooled rapidly, during several minutes, to between 100° C. and 250° C., possibly between 150° C. and 200° C, as a first temperature, by using liquid metal sodium in a liquid metal sodium storage chamber. The liquid metal sodium chamber is thus downstream in the process from the furnace, although not necessary physically downstream. "Downstream" thus refers to the process flow, not to the required physical arrangement.

Here, liquid metal sodium-potassium (NaK) or liquid metal sodium-lithium (NaLi), which is a eutectic alloy made by mixing sodium and potassium or lithium, can be applied instead of the liquid metal sodium. In the case where the liquid metal sodium-potassium (NaK) is employed, the metallic material is further cooled to less than 100° C.

When the metallic material thus cooled is pulled out from the storage chamber, liquid metal sodium still remains on the metallic material. Step 3 is a process for restraining the chemical activation of the remaining liquid metal sodium. The metallic material enters a gas-cooling chamber containing an inert gas, and is cooled during several minutes approximately to room temperature as a second temperature. The gas-cooling chamber is thus downstream in the process flow from the liquid metal sodium chamber.

In Step 4, the metallic material is moved to a liquid metal sodium removal chamber, and the remaining liquid metal sodium on the metallic material is removed by using vapor or water during several minutes. The liquid metal sodium removal chamber is thus downstream in the process flow from the gas-cooling chamber.

Figure 1:
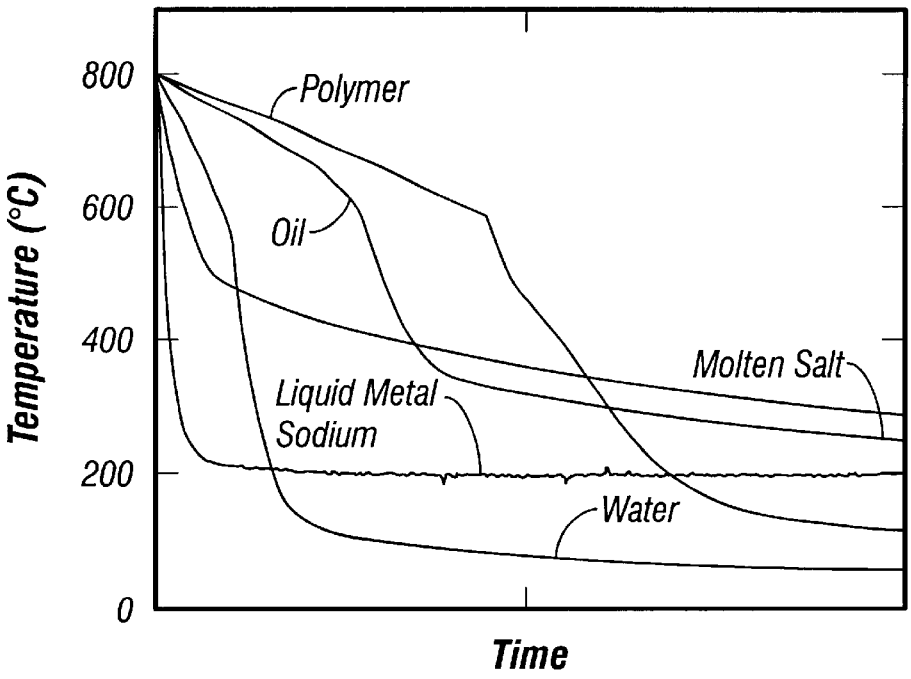
FIG. 1 is a graph showing temperature transitions of a metallic material to be cooled under various coolants.

According to the processes, liquid metal sodium is applied to quench a metallic material. Therefore, if a metallic material heated to more than 700° C. is hardened, the liquid metal sodium never reaches its boiling point, and thereby vapor film is not generated on the metallic material. Further, it is also possible to harden a metallic material such that temperature differences on the metallic material hardly occur by referring the rapid-cooling temperature progress shown in FIG. 1.

Accordingly, deformation, cracking, bending, and distortion of the metallic material can be restrained in quenching processes including a carburization quenching, an induction quenching, or the like. Wear and corrosion of the metallic material can also be diminished.

Figure 3:
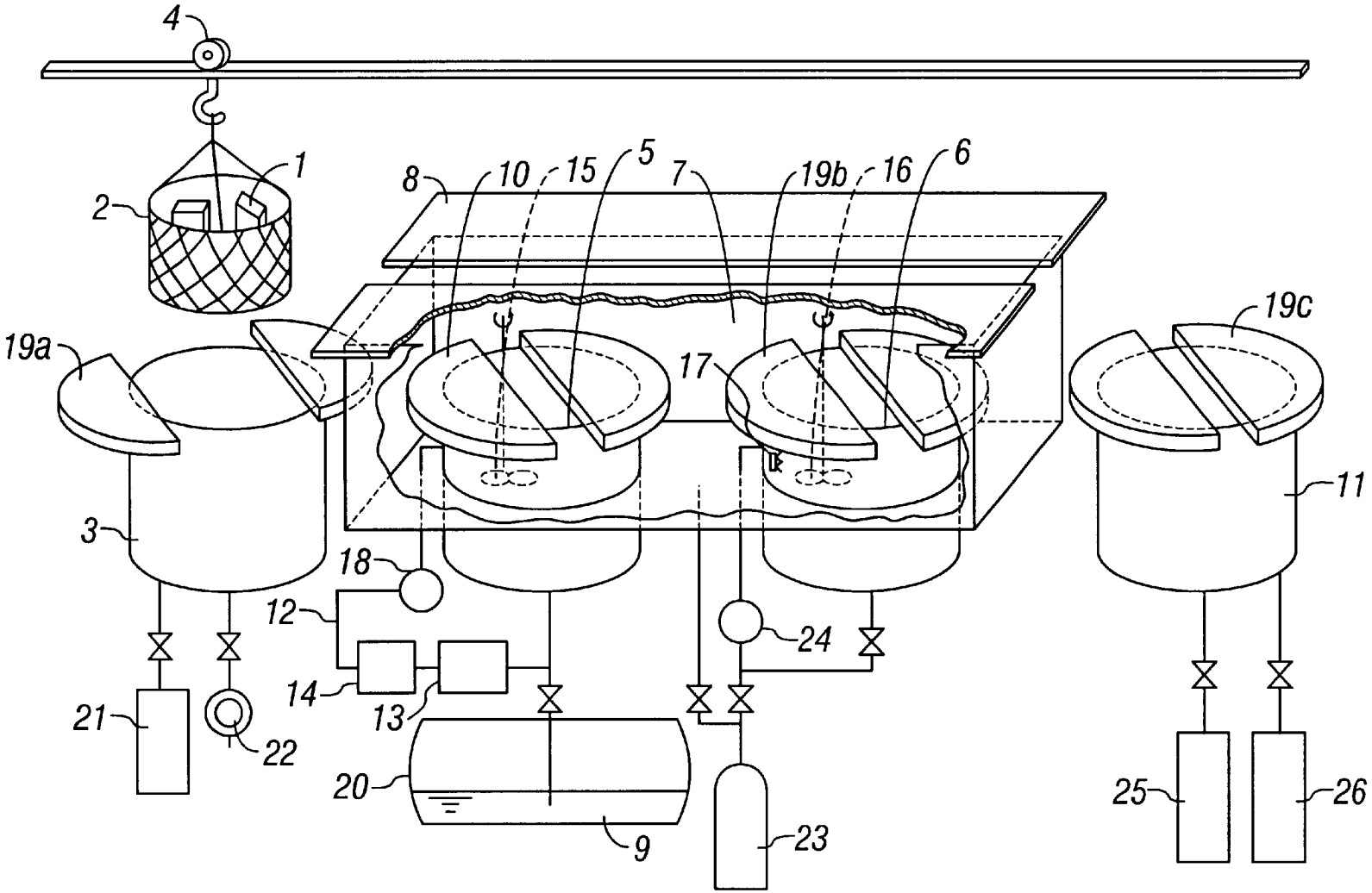
FIG. 3 is a schematic diagram showing an apparatus for quenching a metallic material according to a first embodiment of the present invention.

FIG. 3 is a schematic diagram showing an apparatus for quenching a metallic material according to a first embodiment of the present invention.

As shown in FIG. 3, a quenching apparatus 100 of the first embodiment includes a heating furnace 3, a liquid metal sodium cooling chamber 5, a gas cooling chamber 6, and a liquid metal sodium removal chamber 11. Above the chambers 3, 5, 6, and 11, a transporter 4 is disposed. The transporter 4 can transport metallic materials 1 vertically and horizontally using a cage 2.

The operation of the quenching apparatus is specified hereinafter.

The metallic materials 2, which are to be hardened, such as steels for example, are stored in the cage 2, and are put into the heating furnace 3 through a shield 19*a*. The metallic materials 1 are heated in the heating furnace 3 for a predetermined time period at a predetermined temperature. Note that an atmosphere gas supplier 21 and a vacuum pump 22 are connected to the heating furnace 3.

Here, it is possible to prepare liquid metal sodium or liquid metal lithium having high temperature, for heating the metallic materials 1. The boiling point of the liquid metal sodium is approximately 883° C., and the boiling point of the liquid metal lithium is approximately 1300° C. Thereby, the metallic materials 1 cane be heated to more than 700° C. at ease.

The metallic materials 1 thus processed are then transferred to the liquid metal sodium cooling chamber 5. Here, an inert gas fills an inert gas chamber 7, which is disposed on the upper room of the liquid metal sodium cooling chamber 5 and the gas cooling chamber 6. Therefore, the liquid metal sodium cooling chamber 5 and the gas cooling chamber 6 are isolated from the atmosphere. When the metallic materials 1 are put into the liquid metal sodium cooling chamber 5, a shield 8 on the inert gas chamber 7 is opened first, and afterwards, a shield 10 on the liquid metal sodium cooling chamber 5 is opened. The metallic materials 1 are soaked in liquid metal sodium 9 supplied to the liquid metal sodium cooling chamber 5, and the shield 8 are closed due to avoiding air entering the liquid metal sodium cooling chamber 5.

The metallic materials 1 pulled out from the liquid metal sodium cooling chamber 5 are transferred in the inert gas chamber 7, and put into the gas cooling chamber 6 through a shield 19*d*. The gas cooling chamber 6 is filled with inert gas, and the metallic materials 1 are cooled gradually to room temperature.

The cooled metallic materials 1 are pulled out from the gas cooling chamber 6 and the inert gas chamber 7 and then put into the liquid metal sodium removal chamber 11 through a shield 19*c*. The liquid metal sodium removal chamber 11 can remove the liquid metal sodium remaining on the metallic materials 1 by spraying vapor, mist, and/or water.

The inert gas chamber 7 is preferably connected to an inert gas supplier 23 and a pump 24 and receives inert gas such as nitrogen, argon or the like continuously. Further, the liquid metal sodium removal chamber 11 is connected to an inert gas supplier 25 and a vapor supplier 26.

Here, it is possible to store water in the liquid metal sodium removal chamber 11 for the removal of the remained liquid metal sodium on the metallic materials 1 by soaking therein. Hydrogen may be generated by the reaction of the remained liquid metal sodium and the water; however, the inert gas is filled above the water and thereby explosion can be avoided.

As shown in FIG. 3, the liquid metal sodium 9 is stored in a liquid metal sodium dump tank 20, which is disposed outside the liquid metal sodium cooling chamber 5. The temperature of the liquid metal sodium 9 is kept constant by a temperature controller 13 in a liquid metal sodium circulating line 12 having a circulating pump 18. An impurity remover 14 removes impurities in the liquid metal sodium 9.

In the liquid metal sodium cooling chamber 5, a mixer 15 keeps the temperature of the liquid metal sodium constant and controls the cooling velocity of the metallic materials 2. The liquid metal sodium dump tank 20 is connected to the liquid metal sodium cooling chamber 5 and the liquid metal sodium circulating line 12 via a valve.

In the gas cooling chamber 6, a mixer 16 and an inert gas spray nozzle 17 control the cooling velocity of the metallic materials 2.

The movement of the transporter 4, which transfers the metallic materials 1 from the heating furnace 3 to the liquid metal sodium removal chamber 11, and the open/close movement of the shields 8, 10, 19*a*, 19*b*, and 19*c* are programmed beforehand and are controlled by a computer. Therefore, the quenching apparatus 100 can automatically process the metallic materials 1.

Particularly, at least the shields 8, 10, and 19*b* are preferably controlled strictly, because these shields avoid air contacting the liquid metal sodium so as to prevent combustion.

Consequently, the process steps shown in FIG. 2 are executed by the heating furnace 3, the liquid metal sodium cooling chamber 5, the gas cooling chamber 6, and the liquid metal sodium removal chamber 11 in FIG. 3, respectively. A computer (not shown) can automatically control these process steps.

According to the present embodiment, the quenching apparatus employs liquid metal sodium and moves based on the above-explained processes. Therefore, deformation, cracking, bending, and distortion of the metallic material can be restrained in quenching processes, and thereby wear and corrosion of the metallic material can be diminished.

Figure 4:
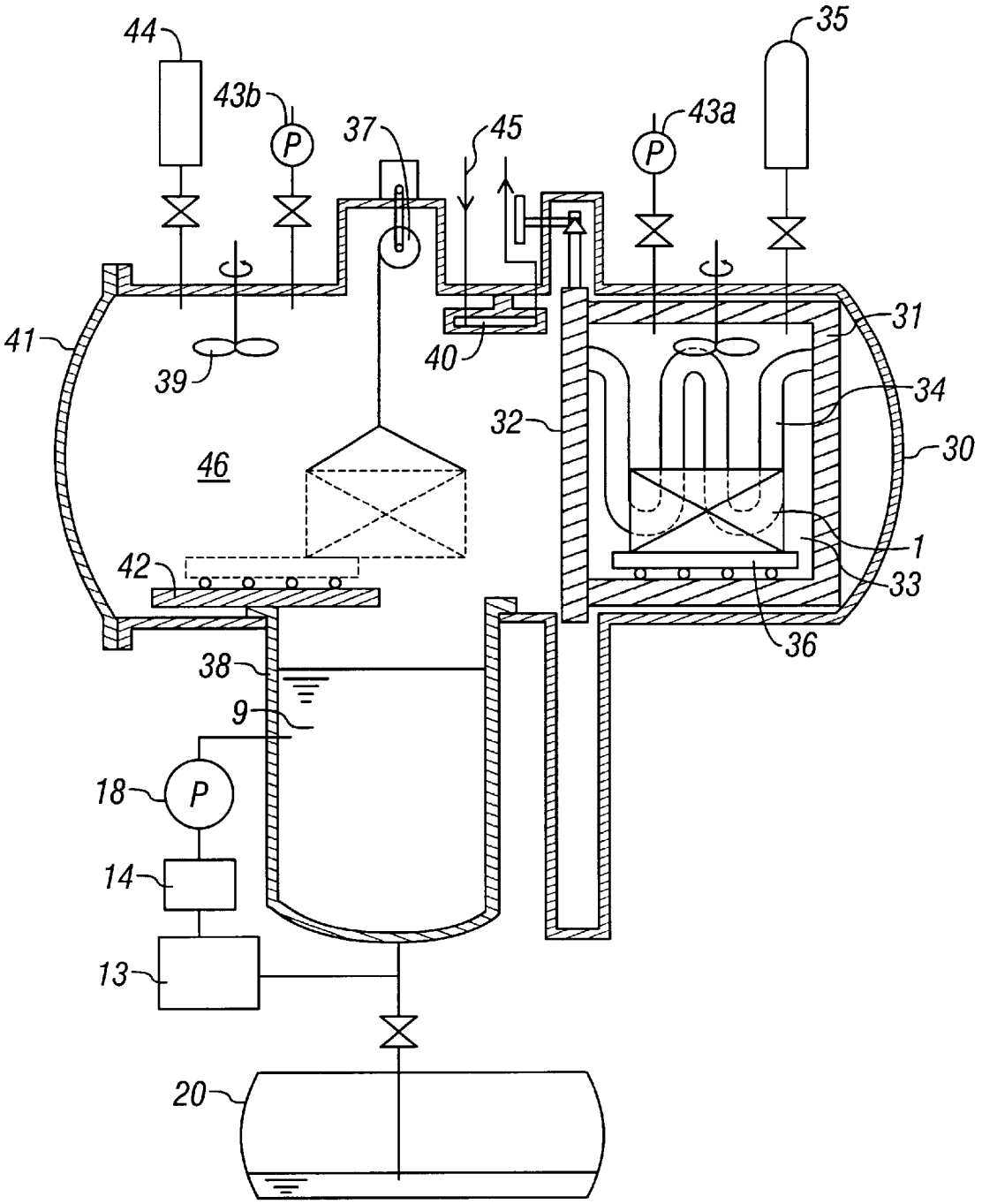
FIG. 4 is a schematic diagram showing an apparatus for quenching a metallic material according to a second embodiment of the present invention.

FIG. 4 is a schematic diagram showing an apparatus for quenching a metallic material according to a second embodiment of the present invention. This embodiment is an example where a carburization quenching is applied.

As shown in FIG. 4, a quenching apparatus has a vacuum chamber 30. The vacuum chamber 30 includes a heating furnace 33, a liquid metal sodium cooling chamber 38, and a liquid metal sodium collector 40. A transporter 36 and a hoister 37 transfer the metallic materials 1 in the vacuum chamber 30. A gas supplier 44 supplies inert gas such as nitrogen or argon to the vacuum chamber 30. Vacuum pumps 43*a* and 43*b* are connected to the vacuum chamber 30 and the heating furnace 33.

The operation of the quenching apparatus is specified hereinafter.

The metallic materials 1 enter the vacuum chamber 30 from an entrance/exit door 41. By using the transporter 36 and the hoister 37, the metallic materials 1 pass through an area 46 and enter the heating furnace 33 surrounded by insulating walls 31 and 32. In the heating furnace 33, a heater 34 heats the metallic materials 1 by using gas energy or electric energy. Afterwards, the gas supplied from a carburizing gas adjuster 35 during a predetermined time period further heats the metallic materials 1. The metallic materials 1 are then sent out from the heating furnace 33 through the area 46 by the transporter 36. The hoister 37 lowers the metallic materials 1, and soaks them into the liquid metal sodium 9 in the liquid metal sodium cooling chamber 38, which is isolated by a shield 42. The liquid metal sodium 9 cools the metallic materials 1 rapidly.

The metallic materials 1 are hoisted up by the hoister 37 from the liquid metal sodium cooling chamber 38, and then cooled down to a room temperature in the area 46 by using a fan 39. The liquid metal sodium 9 that remains on the metallic materials 1 is vaporized, and is condensed and solidified on the liquid metal sodium collector 40. Note that a cooling gas supplier 45 supplies cooling gas for condensing the liquid metal sodium 9 to the collector 40. The metallic materials 1 free from the liquid metal sodium 9 are moved out from the vacuum chamber 30 via the entrance/exit door 41.

According to the embodiment shown in FIG. 4, the area 46 is both upstream and downstream in the process flow from the cooling chamber 38. Further, the area 46 is both a chamber containing an inert gas and a liquid metal sodium remover.

The circulating pump 18 can circulate the liquid metal sodium 9 in the liquid metal sodium cooling chamber 38. During the circulation, the temperature controller 13 keeps the temperature of the liquid metal sodium 9 constant, and the impurity remover 14 removes impurities in the liquid metal sodium 9.

A computer (not shown) can automatically control these process steps, which are shown in FIG. 2.

According to the present embodiment, the quenching apparatus employs liquid metal sodium and moves based on the above-explained processes. Therefore, deformation, cracking, bending, and distortion of the metallic material can be restrained in the carburization quenching processes, and thereby wear and corrosion of the metallic material can be diminished.

Figure 5:
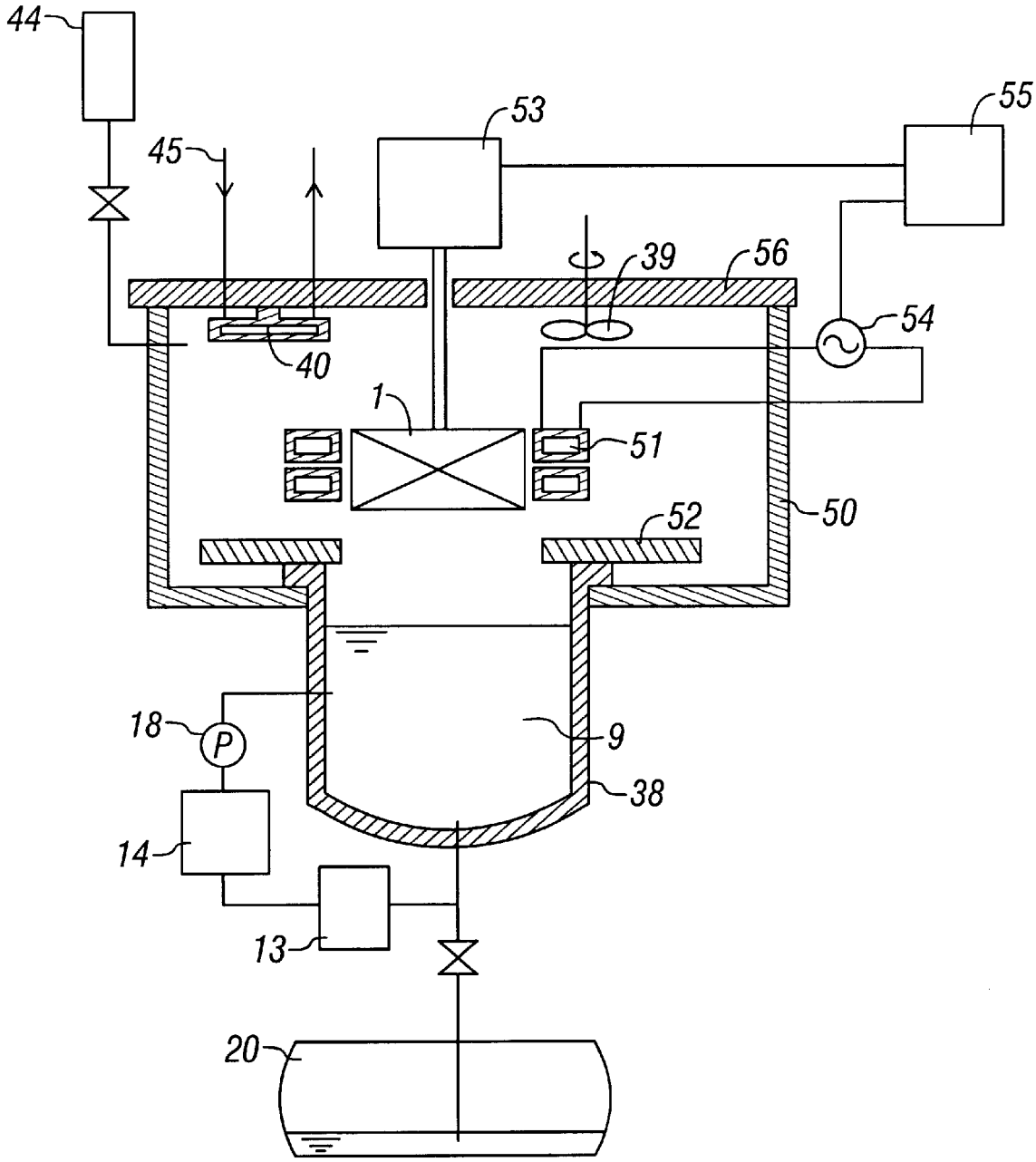
FIG. 5 is a schematic diagram showing an apparatus for quenching a metallic material according to a third embodiment of the present invention.

FIG. 5 is a schematic diagram showing an apparatus for quenching a metallic material according to a third embodiment of the present invention. This embodiment is an example where an induction quenching is applied.

As shown in FIG. 5, a quenching apparatus has an induction heating chamber 50. The induction heating chamber 50 includes an induction coil 51, the liquid metal sodium chamber 38, and the liquid metal sodium collector 40. A high speed driver is disposed to transfer in the metallic materials 1 in the induction heating chamber 50. A gas supplier 44 supplies inert gas such as nitrogen or argon to the induction heating chamber 50.

The operation of the quenching apparatus is specified hereinafter.

The metallic materials 1 enter the induction heating chamber 50 through an entrance/exit door 56. The induction coil 51 heats the surface of the metallic materials 1 rapidly. The high speed driver 53 soaks the heated metallic materials 1 quickly into the liquid metal sodium 9 in the liquid metal sodium chamber 38, which is isolated by a shield 52. Therefore, the metallic materials 1 are cooled rapidly.

Here, the fast speed driver 53 is controlled by a controller 55 to synchronize with an induction power source 54, which supplies electric power to the induction coil 51. This enables to control and adjust the heating time period for the metallic materials 1.

The circulating pump 18 can circulate the liquid metal sodium 9 in the liquid metal sodium cooling chamber 38. During the circulation, the temperature controller 13 keeps the temperature of the liquid metal sodium 9 constant, and the impurity remover 14 removes impurities in the liquid metal sodium 9.

The metallic materials 1 are then hoisted up from the liquid metal sodium cooling chamber 38, and are cooled down in the induction heating chamber 50 to a room temperature by using the fan 39. The liquid metal sodium 9 that remains on the metallic materials 1 is vaporized, and is condensed and solidified on the liquid metal sodium collector 40.

A computer (not shown) can automatically control these process steps, which are shown in FIG. 2.

The induction heating chamber 50 is thus a heater, an inert gas chamber, and a liquid metal sodium remover. The induction heating chamber 50 is both upstream and downstream of the cooling chamber 38.

According to the present embodiment, the quenching apparatus employs liquid metal sodium, and moves based on the above-explained processes. Therefore, deformation, crack, bend, and distortion of the metallic material can be restrained in the induction quenching processes, and thereby wear and corrosion of the metallic material can be diminished.

The foregoing discussion discloses and describes merely a number of exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting, of the scope of the invention, which is set forth in the following claims. Thus, the present invention may be embodied in various ways within the scope of the spirit of the invention.

What is claimed is:

1. An apparatus for quenching a metallic material, comprising:

a heater that heats the metallic material;

a liquid metal sodium chamber in which a liquid metal sodium is supplied, and the metallic material is cooled to a first temperature in the liquid metal sodium;

an inert gas chamber in which an inert gas is supplied, and the metallic material is cooled to a second temperature in the inert gas; and a remover that removes a liquid metal sodium on the metallic material.

2. The apparatus according to claim 1, wherein the liquid metal sodium includes a liquid metal sodium potassium.

3. The apparatus according to claim 1, wherein the liquid metal sodium includes a liquid metal sodium lithium.

4. The apparatus according to claim 1, wherein the heater is disposed in a heating furnace.

5. The apparatus according to claim 4, wherein the heating furnace includes a carburization quenching furnace.

6. The apparatus according to claim 4, wherein the heating furnace includes an induction furnace.

7. The apparatus according to claim 1, wherein the heater heats the metallic material approximately to more than 700° C.

8. The apparatus according to claim 1, wherein the first temperature exists between 100° C. and 250° C.

9. The apparatus according to claim 8, wherein the first temperature exists between 150° C. and 200° C.

10. The apparatus according to claim 1, wherein the heater includes a liquid metal sodium for heating the metallic material.

11. The apparatus according to claim 1, wherein the heater includes a liquid metal lithium for heating the metallic material.

12. The apparatus according to claim 1, wherein an inert gas is supplied to the liquid metal sodium chamber.

13. The apparatus according to claim 1, wherein the second temperature is a room temperature.

14. The apparatus according to claim 1, wherein the remover includes a liquid metal sodium removal chamber.

15. The apparatus according to claim 14, wherein an inert gas is supplied to the liquid metal sodium removal chamber.

16. The apparatus according to claim 1, wherein the remover includes a water.

17. The apparatus according to claim 15, wherein a water is stored in which the metallic material is soaked for removing the remained liquid metal sodium on the metallic material.

18. The apparatus according to claim 1, further comprising a liquid metal sodium circulating line that circulates the liquid metal sodium supplied to the liquid metal sodium chamber.

19. The apparatus according to claim 18, wherein the liquid metal sodium circulating line includes a circulating pump.

20. The apparatus according to claim 1, further comprising a temperature controller that keeps the temperature of the liquid metal sodium supplied to the liquid metal sodium chamber constant.

21. The apparatus according to claim 1, further comprising an impurity remover that removes an impurity in the liquid metal sodium supplied to the liquid metal sodium chamber.

22. The apparatus according to claim 1, further comprising a mixer that mixes the liquid metal sodium supplied in the liquid metal sodium chamber.

23. The apparatus according to claim 11, further comprising a mixer that mixes the inert gas supplied in the liquid metal sodium removal chamber.

24. The apparatus according to claim 11, further comprising a mixer that mixes the inert gas supplied in the liquid metal sodium removal chamber.

25. The apparatus according to claim 1, further comprising a shield that avoids air contacting the liquid metal sodium.

26. The apparatus according to claim 1, further comprising a transporter that transports the metallic material for the processes.

27. An apparatus for quenching a metallic material, comprising:

a heater at a first temperature;

a first chamber downstream from the heater and containing a liquid metal sodium at a second temperature lower than the first temperature;

a second chamber downstream from the first chamber and containing an inert gas at a third temperature lower than the second temperature; and a liquid metal sodium remover downstream from the second chamber.

28. The apparatus according to claim 27, wherein the second chamber and the remover share a common space.

29. The apparatus according to claim 27, wherein the second chamber, the remover, and the heater share a common space.

30. An apparatus for quenching a metallic material, comprising:

a heater for heating the metallic material to a first temperature;

a first chamber containing a liquid metal sodium at a second temperature lower than the first temperature for cooling the metallic material heated to the first temperature;

a second chamber containing an inert gas at a third temperature lower than the second temperature for cooling the metallic material; and a liquid metal sodium remover for removing a liquid metal sodium from the metallic material.

31. The apparatus according to claim 30, wherein the second chamber and the remover share a common space.

32. The apparatus according to claim 30, wherein the second chamber, the remover, and the heater share a common space.

33. A method of quenching a metallic material, comprising:

heating the metallic material to a first temperature;

cooling the metallic material in a liquid comprising a liquid metal sodium to a second temperature lower than the first temperature;

cooling the metallic material in an inert gas to a third temperature lower than the second temperature; and removing a liquid metal sodium from the metallic material cooled to at least the third temperature.

* * * * *